US008807373B1

(12) United States Patent
Russell

(10) Patent No.: US 8,807,373 B1
(45) Date of Patent: Aug. 19, 2014

(54) FOOD TRAY

(71) Applicant: Franklin W. Russell, Kingsland, GA (US)

(72) Inventor: Franklin W. Russell, Kingsland, GA (US)

( * ) Notice: Subject to any disclaimer, the term of this patent is extended or adjusted under 35 U.S.C. 154(b) by 0 days.

(21) Appl. No.: 13/787,964

(22) Filed: Mar. 7, 2013

Related U.S. Application Data

(60) Provisional application No. 61/750,230, filed on Jan. 8, 2013.

(51) Int. Cl.
*B65D 77/20* (2006.01)
*A47G 19/03* (2006.01)

(52) U.S. Cl.
CPC ..... *A47G 19/03* (2013.01)
USPC ..... 220/359.1

(58) Field of Classification Search
CPC ..... B65D 1/34; B65D 1/36; B65D 1/40; B65D 75/54; B65D 75/02
USPC ..... 220/575, 516, 522, 526, 556, 359.1
See application file for complete search history.

(56) References Cited

U.S. PATENT DOCUMENTS 2,674,536 A * 4/1954 Fisher ..... 426/114
3,595,425 A 7/1971 Eicholtz et al.
3,845,875 A 11/1974 Douglas et al.
4,355,755 A 10/1982 Faller
4,495,749 A * 1/1985 Faller ..... 53/471
4,545,487 A 10/1985 Asmus
4,636,273 A * 1/1987 Wolfersperger ..... 156/244.11
4,939,332 A * 7/1990 Hahn ..... 219/734
5,042,652 A * 8/1991 Grindrod ..... 229/164.1
D335,796 S 5/1993 Barnes
6,152,302 A * 11/2000 Miller et al. ..... 206/549
6,691,886 B1 * 2/2004 Berndt et al. ..... 220/359.1
D582,726 S 12/2008 Olsson
D606,885 S 12/2009 Olsson
2002/0108955 A1 * 8/2002 Erb ..... 220/359.4
2003/0006238 A1 * 1/2003 Iacovelli ..... 220/575
2003/0141218 A1 * 7/2003 Stephens et al. ..... 206/820
2003/0141309 A1 * 7/2003 Agarwal et al. ..... 220/575
2005/0269234 A1 * 12/2005 Gore et al. ..... 206/524
2008/0242736 A1 * 10/2008 Fuisz ..... 514/770
2010/0126991 A1 * 5/2010 Kimura et al. ..... 220/200
2010/0176133 A1 * 7/2010 Yousif et al. ..... 220/359.3
2010/0326878 A1 * 12/2010 Mangino et al. ..... 206/561
2012/0152954 A1 * 6/2012 Bruehl et al. ..... 220/265

OTHER PUBLICATIONS

X.J.L. Clairbois, Optimal Binary Space Partitions, Master Thesis, Technische Universiteit Eindhoven (DE), 2008.

* cited by examiner

*Primary Examiner* — Steven A. Reynolds
*Assistant Examiner* — King M Chu
(74) *Attorney, Agent, or Firm* — KB Patents; Luca D'Ottone

(57) ABSTRACT

The inventive device object of the present application is a rigid plastic tray with sections for different foods that is made from the most affordable plastic available. Its design could be sold in bulk to keep the price low but would clearly be for just a single use. It is emphasized that this abstract is provided to comply with the rules requiring an abstract that will allow a searcher or other reader to quickly ascertain the subject matter of the technical disclosure.

11 Claims, 8 Drawing Sheets

FOOD TRAY

CLAIM OF PRIORITY FROM RELATED APPLICATIONS

The present application claims priority from U.S. Provisional Patent Application No. 61/750,230 filed on Jan. 8, 2013 to Russel W. Franklin, directed to a TRAYSTICK, that is hereby incorporated by reference.

BACKGROUND OF THE INVENTION

1. Field of the Invention

The present invention generally relates to food trays and more specifically to a rigid plastic tray with sections for different foods that is made from the most affordable plastic available. The inventor commonly refers to the food tray of the present invention as to the: "Traystick".

2. Brief Description of the Prior Art

Portable and reusable trays are well known in the art. Various patents and Published patent applications are in fact directed to plastic trays. While developing the invention of the instant application independently the Inventor researched extensively the public record as well as the current market for portable and reusable trays and the most relevant examples found in the search are mentioned in the Information Disclosure Statement (IDS) attached.

Despite all the efforts listed above prior art patents describe structures that are either not truly convenient or else involve complicated, expensive, and overly difficult assembly and/or disassembly parts and procedures. In the specific TrayStick features a much simpler and basic design, if compared with the prior art, that does not wish to stray from the design of typical food packaging trays as other patents wish but rather focuses on making them more convenient and disposable than traditional reusable food trays.

TrayStick is less expensive and strives to allow consumers to transport their meals a relatively short distance rather than a long distance. It is less complicated and would require a simpler and quicker manufacturing process than the devices described in the patent documents mentioned in the IDS. Other devices have been advertised on various media but never patented or described into a printed publication.

SUMMARY OF THE INVENTION

The invention is a rigid plastic tray with sections for different foods that is made from the most affordable plastic available. Its design could be sold in bulk to keep the price low but would clearly be for just a single use.

It is then the principal object of the present invention is to provide a disposable device where food can be easily heated or steamed in the microwave.

It is a secondary objective of the present invention to provide a device that is designed for those who carry meals to the workplace, this could be useful in other venues such as a meal delivery programs like Meals-on-Wheels.

It is an additional objective of the present invention to provide a device that does not rust or deteriorate over time. It is a final objective of the present invention to provide for a device that is relatively inexpensive to build, but that can eventually be sold at a premium.

These and other objective achieved by the device of the present invention will be apparent by the drawings, by their detailed description, and by the specification here from appended.

DESCRIPTION OF THE PREFERRED EMBODIMENT

Figure 1:
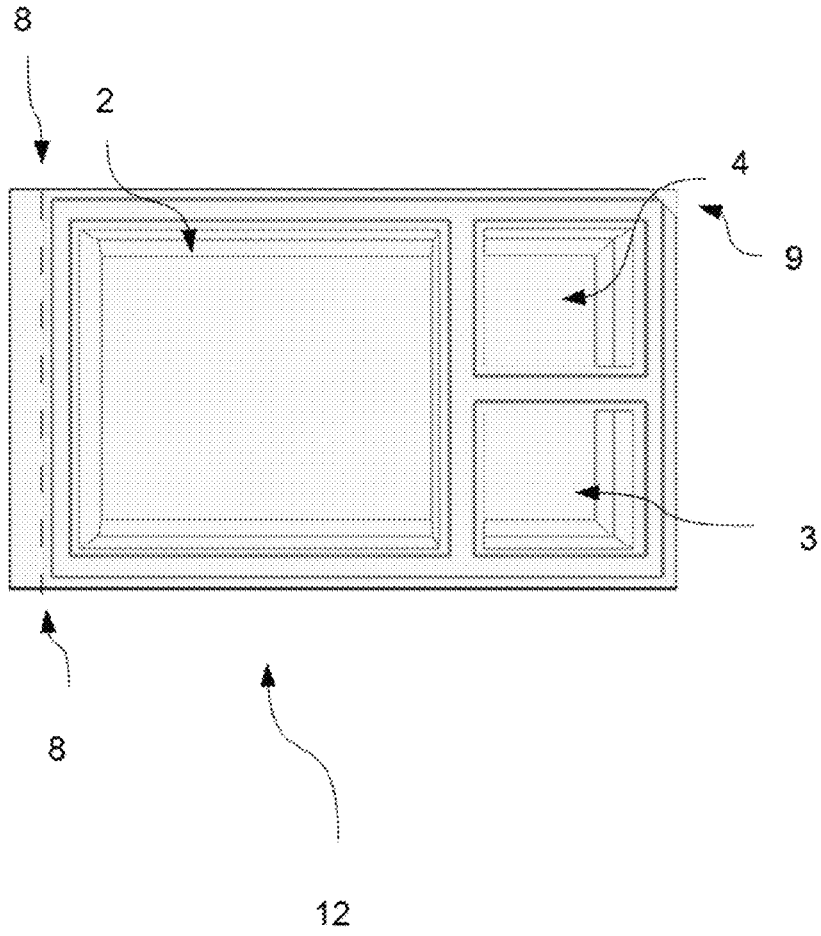
FIG. 1 is a top elevation view of one of the preferred embodiments of the "Traystick" food tray in accordance with the teaching of the present invention.
Figure 2:
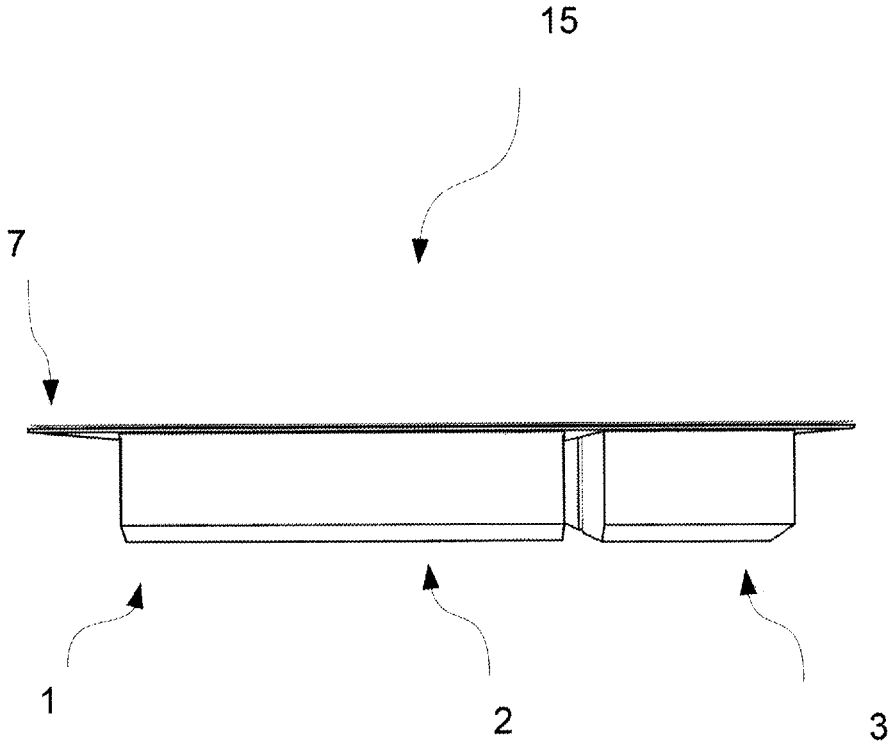
FIG. 2 is a left elevation view of the "Traystick" food tray of FIG. 1.
Figure 3:
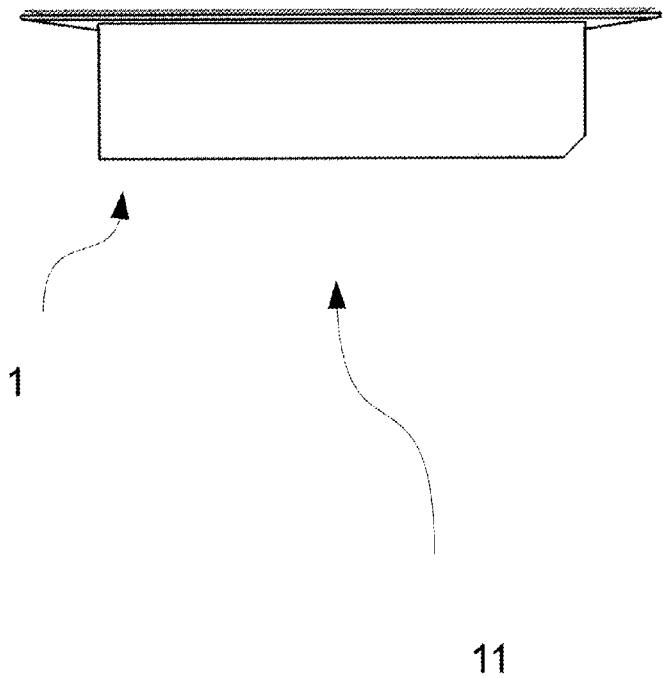
FIG. 3 is a back side elevation view of the "Traystick" food tray of FIG. 1.
Figure 4:
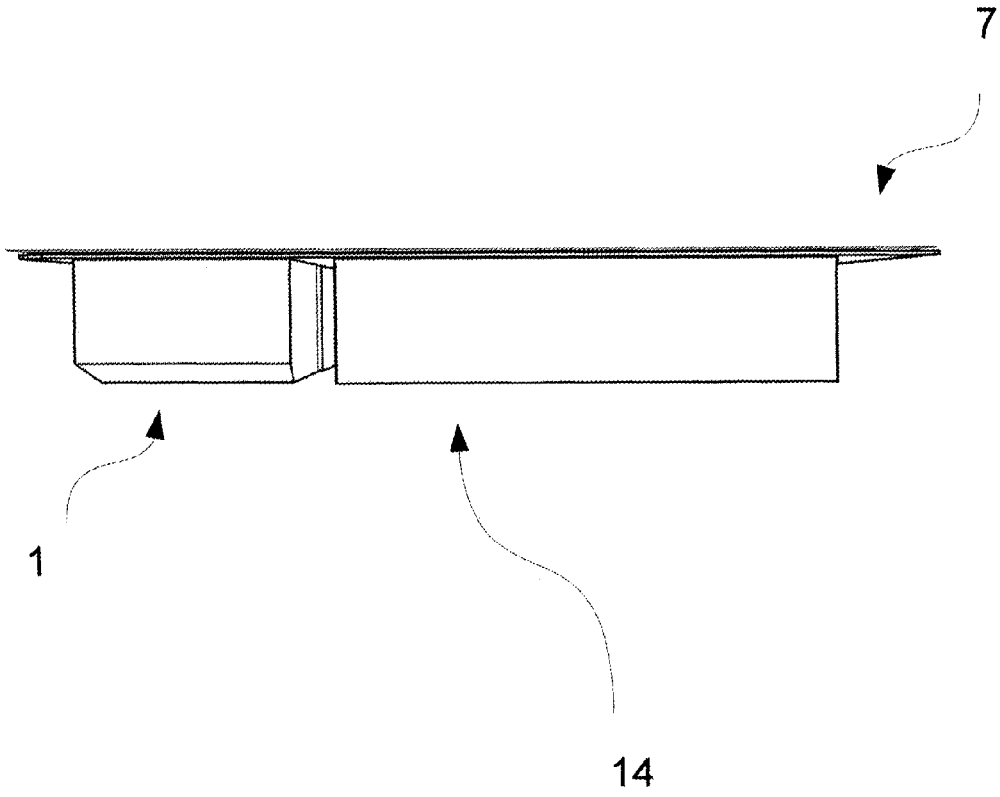
FIG. 4 is a right side elevation view of the "Traystick" food tray of FIG. 1.
Figure 5:
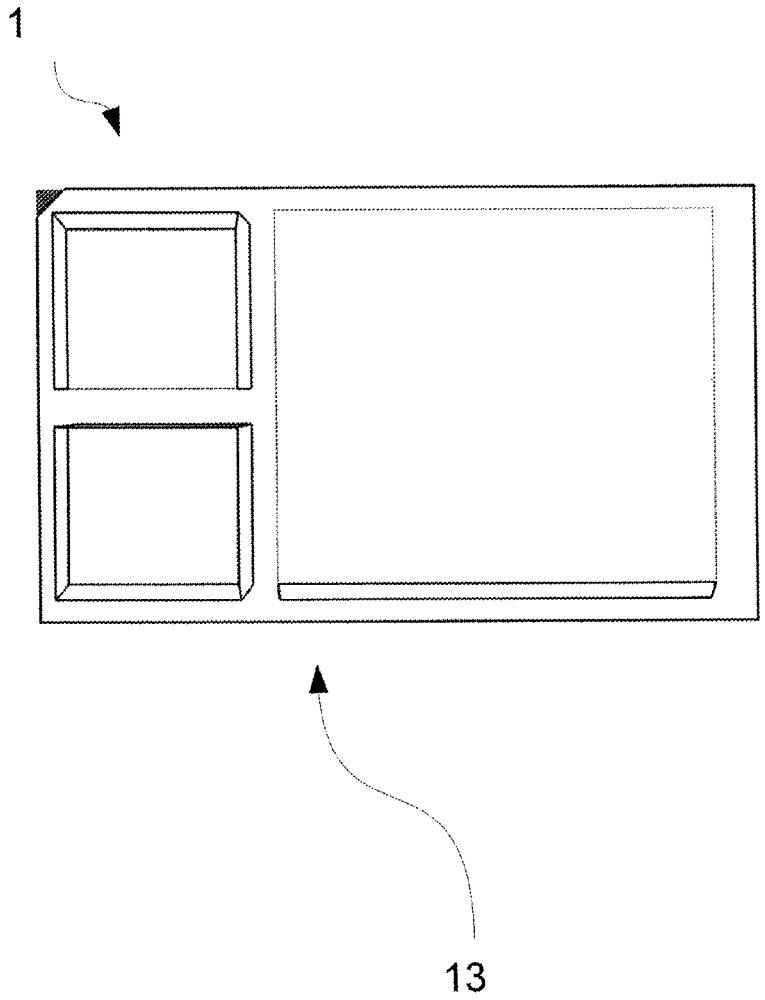
FIG. 5 is a bottom elevation view of the "Traystick" food tray of FIG. 1.
Figure 6:
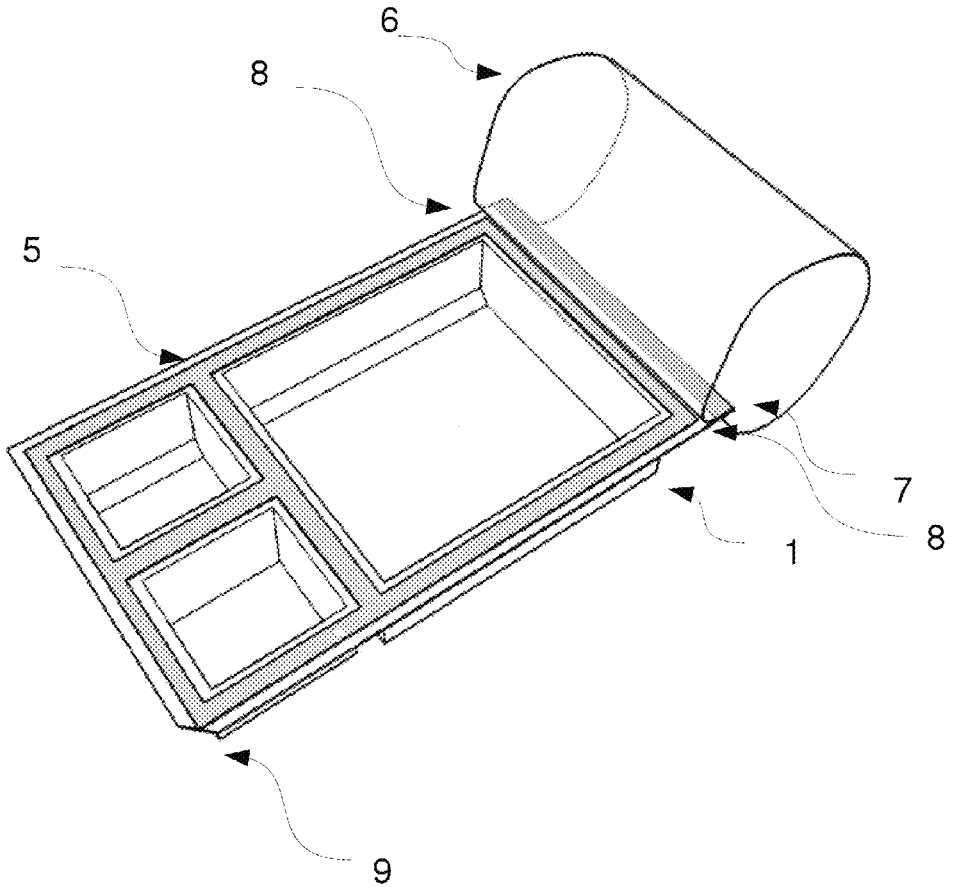
FIG. 6 is a top perspective view of the "Traystick" food tray of FIG. 1 with the plastic cover peeled out.
Figure 7:
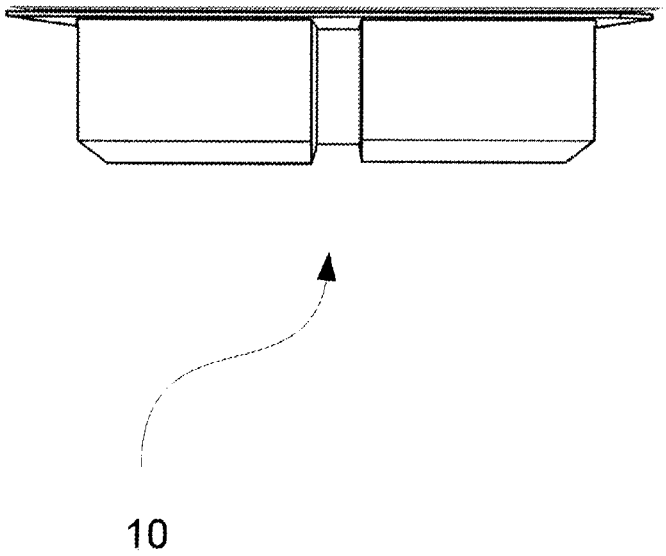
FIG. 7 is a front elevation view of the "Traystick" food tray of FIG. 1.
Figure 8:
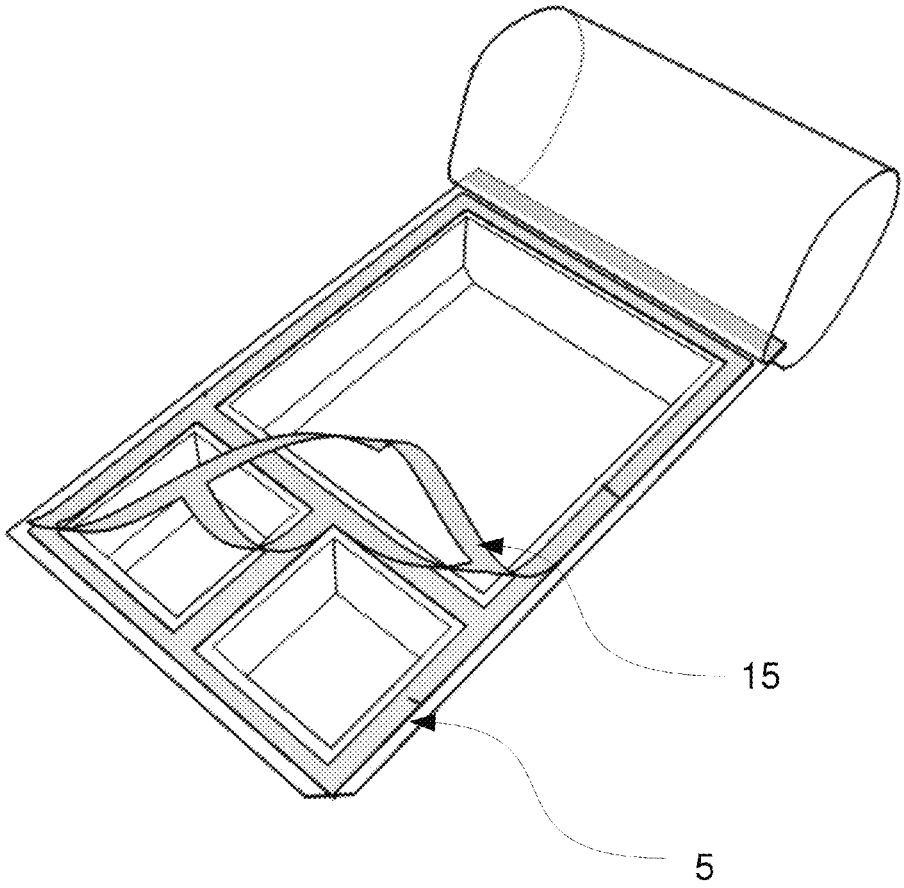
FIG. 8 is a perspective view of "Traystick" food tray of FIG. 1 and its adhesive cover strip (5) whose composition is critical since must be peelable and removable, and allow for the peeling and removing also of the transparent plastic cover (6).

The invention is a rigid plastic tray with sections for different foods that is made from the most affordable plastic available. As it can be inferred from the drawings, essential components of "Traystick" of the present application include: a plastic dishwear container, a peal cover (16), an adhesive cover strip, a clear adhesive, and a perforated edge. As it can be inferred from the drawings essential components of the "Traystick" food tray of described in the present application include: a base member (1) generally subdivided at least in three generally rectangular compartments, of which, one having a relative bigger size (2) and two having relative smaller size (3) & (4); an adhesive (sticky) layer (5) placed on the upper side of said base member (1), securing a transparent plastic cover (6) over said upper surface of said base member (1); said transparent plastic cover (6) is physically molded into a side support bar (7) connected to said base member (1) via a perforated strip (8) for easy removal, while on the opposite side of said perforated strip a unattached triangle (9) of the transparent plastic cover (6) serves as handle.

TrayStick is designed to be very affordable as it could be purchased in bulk. It is a tray with individualized compartments. Around the top edge of each compartment is a thin line of adhesive protected by a plastic film. When using TrayStick the compartments are filled with food, the film protecting the adhesive is peeled off, and then a pre-staged piece of plastic is folded down over the entire top adhering securely to the top edges of each compartment sealing the food into its compartment. When ready to eat there is the option of steaming the food in the microwave (poke holes in the plastic) or just peel the plastic back to where it hangs over the edge of the tray and the meal is ready. When finished the whole container can be thrown away guilt-free.

Various microwave safe adhesive substances exists and are available for the manufacturing of said sticky layer (5). For example in one of the preferred embodiments of the "Traystick" food tray disclosed in the present application the adhesive (sticky) layer 5 is produced by mixing a cellulose-based adhesive agent with a urethane resin-based hot melt adhesive agent. In such a case, the cellulose-based adhesive agent is easily dissolved with the urethane resin-based hot melt adhesive agent, and is lower in its adhesive force than the hot melt adhesive agent. Other adhesive compounds that have been reported to be suitable for microwave and food exposure are Cyanoacrylate Esters.

Under the teachings of the present invention various mircowave safe plastics exist including: polyethylene terephthalate (PET), high density polyethylene (HDPE), some kinds of low density polyethylene (LDPE), some forms of polypropylene.

One of the preferred embodiments of the disposable and microwaevable food tray comprises a generally cuboidal base member (1) having six sides a front side (10), a back side (11), a top side (12), a bottom side (13), a right side (14), and a left side (15). The base member (1) is subdivided at in a plurality of generally rectangular compartments and it has an adhesive layer (5) placed on its top side (12), securing a transparent plastic cover (6) over its upper surface. In a separate preferred embodiment said plurality of generally rectangular compartment means at least three compartments. The compartments may all have the same size and shape or may come in different shapes to accommodate various dishes that the user may want to microwave. It has been proven that we optimal free partition for a set of arbitrary disjoint line segments in the plane with a restricted two sides spaces which cuts no more than three times as many line segments as the free optimal planar space. Thus the optimal number of compartments under the teachings of the present invention is 3.

Said transparent plastic cover (6) is physically molded into a side support bar (7) connected to the body of said base member (1) via a perforated strip (8), featuring on the opposite side an unattached triangle (9) of the transparent plastic cover to serve as handle. The disposable and microwaevable food tray may be made by a plastic material, that is safe both for food use and for microwave use, selected from the group consisting of PET, HDPE, LDPE, and polypropylene.

The adhesive layer may produced by mixing a cellulose-based adhesive agent with a urethane resin-based hot melt adhesive agent, or may be made by Cyanoacrylate Esters. The bottom line is that the composition of the adhesive is critical since must be peelable and removable, and allow for the peeling and removing also of the transparent plastic cover (6), but at the same time must be safe to use in a microwave and is not supposed to contaminate the food at high temperatures.

Various preferred design of the microwaeble food tray of the present application teach different positions for said perforated strip to attach to the front side of said base member: it can be attached to any of the front, back, left, or right sides.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable and microwaevable food tray comprising a generally cuboidal base member made by a plastic material selected from the group consisting of PET, HDPE, LDPE, and polypropylene having six sides a top side, a bottom side, a front side, and a back side; said base member subdivided in a plurality of generally rectangular compartments having a peelable adhesive layer produced by mixing a cellulose-based adhesive agent with a urethane resin-based hot melt adhesive agent placed on said top side, where when not in use said peelable adhesive layer is protected by a peel cover; where when in use said peelable adhesive layer secures a transparent plastic cover over said upper surface of said base member; said transparent plastic cover being physically molded into a side support bar connected to the body of said base member via a perforated strip, while featuring on the opposite side of said perforated strip an unattached triangle of the transparent plastic cover to serve as handle.

2. The disposable and microwaevable food tray of claim 1 where said adhesive layer is made by Cyanoacrylate Esters.

3. The disposable and microwaevable food tray of claim 1 where said adhesive layer is peelable.

4. The disposable and microwaevable food tray of claim 1 where said adhesive layer is removable.

5. The disposable and microwaevable food tray of claim 1 where said transparent plastic cover is peelable.

6. The disposable and microwaevable food tray of claim 1 where said transparent plastic cover is removable.

7. The disposable and microwaevable food tray of claim 1 where said base member is subdivided in at least three generally rectangular compartments.

8. The disposable and microwaevable food tray of claim 1 where said three generally rectangular compartments have the same shape.

9. The disposable and microwaevable food tray of claim 1 where said three generally rectangular compartments have the same size.

10. The disposable and microwaevable food tray of claim 1 where said three generally rectangular compartments have different rectangular shapes.

11. The disposable and microwaevable food tray of claim 1 where said three generally rectangular compartments have different sizes.

* * * * *